US008511485B2

(12) United States Patent
Hernandez et al.

(10) Patent No.: US 8,511,485 B2
(45) Date of Patent: Aug. 20, 2013

(54) MODULAR WAVE SHAPED MERCHANDISER RACK

(75) Inventors: Hector R. Hernandez, Fullerton, CA (US); Paul Carbajal, Commerce, CA (US)

(73) Assignee: Alltrade Tools, LLC, Long Beach, CA (US)

( * ) Notice: Subject to any disclaimer, the term of this patent is extended or adjusted under 35 U.S.C. 154(b) by 280 days.

(21) Appl. No.: 12/909,597

(22) Filed: Oct. 21, 2010

(65) Prior Publication Data

US 2012/0097625 A1 Apr. 26, 2012

(51) Int. Cl.
*A47F 7/00* (2006.01)

(52) U.S. Cl.
USPC ..... 211/70.6; 211/87.01; 211/106.01; 248/307

(58) Field of Classification Search
USPC ..... 211/189, 125, 86.01, 87.01, 106.01, 211/70.1, 70.6, 85.3; 248/300, 303, 304, 248/307; 160/327, 348, 349.1; D6/567, D6/569
See application file for complete search history.

(56) References Cited

U.S. PATENT DOCUMENTS

| | | | | | |
|---|---|---|---|---|---|
| 1,991,156 | A * | 2/1935 | Kahn et al. | 211/45 |
| 2,983,352 | A * | 5/1961 | De Flora et al. | 193/35 R |
| 5,141,116 | A * | 8/1992 | Mojica | 211/60.1 |
| 5,178,288 | A * | 1/1993 | Werner et al. | 211/151 |
| 5,318,176 | A * | 6/1994 | Kaspersen et al. | 211/87.01 |
| 5,333,743 | A * | 8/1994 | Loewke et al. | 211/106.01 |
| D412,804 | S * | 8/1999 | Romeo | D6/567 |
| D413,471 | S * | 9/1999 | Romeo | D6/567 |
| 7,100,776 | B2 * | 9/2006 | Berfield | 211/70.6 |
| 7,114,606 | B2 * | 10/2006 | Shaw et al. | 193/35 R |
| 7,200,903 | B2 * | 4/2007 | Shaw et al. | 24/453 |
| 2004/0020881 | A1 * | 2/2004 | Wuerth | 211/85.7 |

* cited by examiner

*Primary Examiner* — Korie H Chan
(74) *Attorney, Agent, or Firm* — David J. Pitman; Fulwider Patton LLP

(57) ABSTRACT

A display rack that permits a vendor of goods to display goods for sale in an advantageous way, that permits maximizing the number of items that can be displayed in a fixed linear space.

13 Claims, 12 Drawing Sheets

MODULAR WAVE SHAPED MERCHANDISER RACK

BACKGROUND

The present invention relates generally to merchandise display systems, and more particularly, is directed to a display system that may be used with a pegboard and hook type of support system. Specifically, the invention relates to a pegboard and hook type system that is capable of supporting and storing a wide variety of similarly shaped products in a manner that permits highly advantageous use of limited space available.

Numerous display systems employing pegboards have been developed in the prior art for hanging and displaying a great variety of goods. The prior art display systems have incorporated conventional pegboards, that is, a planar board which is usually composed of one-eighth inch or larger hardboard and which has been drilled to provide spaced horizontal and vertical rows of openings generally positioned at about one inch intervals. A typical pegboard 600 is shown in FIG. 10, with a matrix of holes 602. Cooperating bent wire hooks have been designed and have been provided for removable connection to the pegboard by applying end portions of the hooks within the pegboard openings to thereby provide a hanging attachment of predetermined configuration for hanging and displaying the various items to be stored and vended.

More comprehensive systems have been developed to display complete lines of similar or related merchandise, for example, tools for auto parts, plumbing parts, electrical parts, and the like.

Under the system for selling products that is emerging in today's retail market, large outlet stores will grant, or "rent," a product manufacturer a fixed linear amount of shelf space in the store to display the manufacturer's goods. Clearly, the manufacturer is well advised to create a display structure that will allow the maximum amount of its product to be displayed for sale in the limited available space. However, known systems for displaying goods suffer from the disadvantage of having "dead space." By "dead space" it is meant that an item of merchandise cannot be suspended at the point of dead space because to do so would conflict with structure that is dedicated to supporting the display unit itself. For example, prior art structures known in the art and disclosed in U.S. design patents D 412,804 and D 413,471, and as shown in FIGS. 11 and 12 hereto exemplify units which have "dead space" at the left and right extremities of each unit. If units such as those shown in FIGS. 10 and 11 are placed side by side in sequence on a pegboard, the point of abutment between two adjacent units is a "dead space" because an item of merchandise cannot be suspended at that point of abutment between the two units, the cause being the interference between the arms supporting the unit, and the support structure for the item of merchandise.

Accordingly, there is a need in the art to provide a display system that allows a maximum number of merchandise items to be displayed in a limited linear amount of shelf space. The present invention addresses these and other needs.

SUMMARY OF THE INVENTION

The present invention is a modular system of merchandizing display that is configured to maximize the amount of merchandize that can be displayed within the parameters of space that is provided to permit the display. In a first preferred embodiment of the invention, the system includes a modular rack for displaying merchandise comprising at least two bars, each bar having an asymmetrical shape and comprising a left support portion that is linear and extends along a line, a right support portion that is linear and extends co-linearly along the same line as the left support portion, the right support portion being spaced apart from the left support portion. A front apex portion is provided, being linear and extending parallel to the line, the front apex portion having a left terminal end and a right terminal end. A left angled portion is provided that is linear, and is connected to the left terminal end of the front apex portion, and extends backwards and also leftwards away from the front apex portion. A right angled portion is provided that is linear, and is connected to the right terminal end of the front apex portion, and extends backwards and also rightwards away from the front apex portion. A rear apex portion is provided that is linear, and is connected to a right terminal end of the right angled portion, and extends parallel to the line. A left spacer portion is provided that is linear, is connected at one end to a left terminal end of the left angled portion and is connected at an opposite end to a left terminal end of the left support portion, the left spacer portion and the left support portion being connected perpendicular to each other. A right spacer portion is provided that is linear and has the same length as the left spacer portion, the right spacer portion being connected at one end to a right terminal portion of the rear apex portion, and is connected at an opposite end to a right terminal end of the right support portion, the right spacer portion and the right support portion being connected perpendicular to each other. At least one hook is attached to each of the right hand support portion and the left hand support portion of each bar, each hook being configured for insertion into a hole of a pegboard for providing support to the rack. As a result of this configuration, juxtaposition of the two non-linear bars beside each other with the right spacer portion of a first non-linear bar abutting the left spacer portion of an adjacent non-linear bar results in a wave shaped pattern comprising the left angled portion, the front apex portion, the right angled portion and the rear apex portion of each non-linear bar. This configuration has the advantageous result that it allows a symmetrical pattern to be created when a plurality of units are mounted adjacent each other in an abutting relationship on a pegboard. Specifically, the pattern is advantageous for the purpose of hanging tools from the plurality of units because it advantageously increases the number of tools that may be hung in a fixed linear space for merchandising to the public.

In a preferred aspect of the modular rack each of the left spacer portion and the right spacer portion are between 0.5 inches and 1.5 inches in length. Further, each of the left angled portion and the right angled portion are between 4 inches and 7 inches in length. Additionally, the right angled portion has the same length as the left angled portion. In a further preferred aspect the left angled portion extends backwards and leftwards away from the front apex portion at a first angle, and the right angled portion extends backwards and rightwards away from the front apex portion at a second angle that is the same as the first angle, so that the left and right angled portions form a "V" shape, with the front apex portion situated at the apex of the "V." Additionally, the first angle and the second angle are between 30 degrees and 40 degrees, and the left spacer portion joins the left support portion at a right angle, and the right spacer portion joins the right support portion at a right angle.

In another aspect, the invention includes a modular rack for displaying merchandise comprising at least two bars, each bar having an asymmetrical shape and comprising a plurality of front apex portions that are linear and extend parallel to a horizontal line, the front apex portions each having a left terminal end and a right terminal end. A plurality of left angled portions are provided that are linear, each one connected to a left terminal end of a respective one of the front apex portions, and extending backwards and also leftwards away from the respective front apex portion. A plurality of right angled portions are provided that are linear, each one connected to a right terminal end of a respective one of the front apex portions, and extending backwards and also rightwards away from the front apex portion. A plurality of rear apex portion are provided that are linear, each one connected to a right terminal end of a respective right angled portion, and extending parallel to the horizontal line. A left spacer portion is provided that is linear extending perpendicular to the line, is connected at one end to a left terminal end of an extreme left angled portion, and is provided with a hook for connection to a pegboard. A right spacer portion is provided that is linear extending perpendicular to the line and has the same length as the left spacer portion, the right spacer portion being connected at one end to a right terminal portion of a right extreme rear apex portion, and is provided with a hook for connection to a pegboard. As a result of the foregoing configuration, juxtaposition of the two non-linear bars beside each other with the right spacer portion of a first non-linear bar abutting the left spacer portion of an adjacent non-linear bar results in a uniform wave shaped pattern comprising left angled portions, front apex portions, right angled portions and rear apex portions of each non-linear bar. As in the case of the first embodiment, this configuration has the advantageous result that it allows a symmetrical pattern to be created when a plurality of units are mounted adjacent each other in an abutting relationship on a pegboard. Specifically, the pattern is advantageous for the purpose of hanging tools from the plurality of units because it advantageously increases the number of tools that may be hung in a fixed linear space for merchandising to the public.

In a preferred aspect of this embodiment, each of the left spacer portions and the right spacer portions are between 0.5 inches and 1.5 inches in length, and each of the left angled portions and the right angled portions are between 4 inches and 7 inches in length. Furthermore, it is preferred that all the right angled portions have the same length as all the left angled portions. Additionally, in a preferred aspect, each left angled portion extends backwards and leftwards away from the respective front apex portion at a first angle, and each right angled portion extends backwards and rightwards away from the respective front apex portion at a second angle that is the same as the first angle, so that the left and right angled portions form a "V" shape, with the front apex portion situated at the apex of the "V." In yet a further preferred aspect, first angle and the second angle are between 30 degrees and 40 degrees.

These and other advantages of the invention will become more apparent from the following detailed description thereof and the accompanying exemplary drawings.

DETAILED DESCRIPTION OF THE PREFERRED EMBODIMENTS

Figure 1:
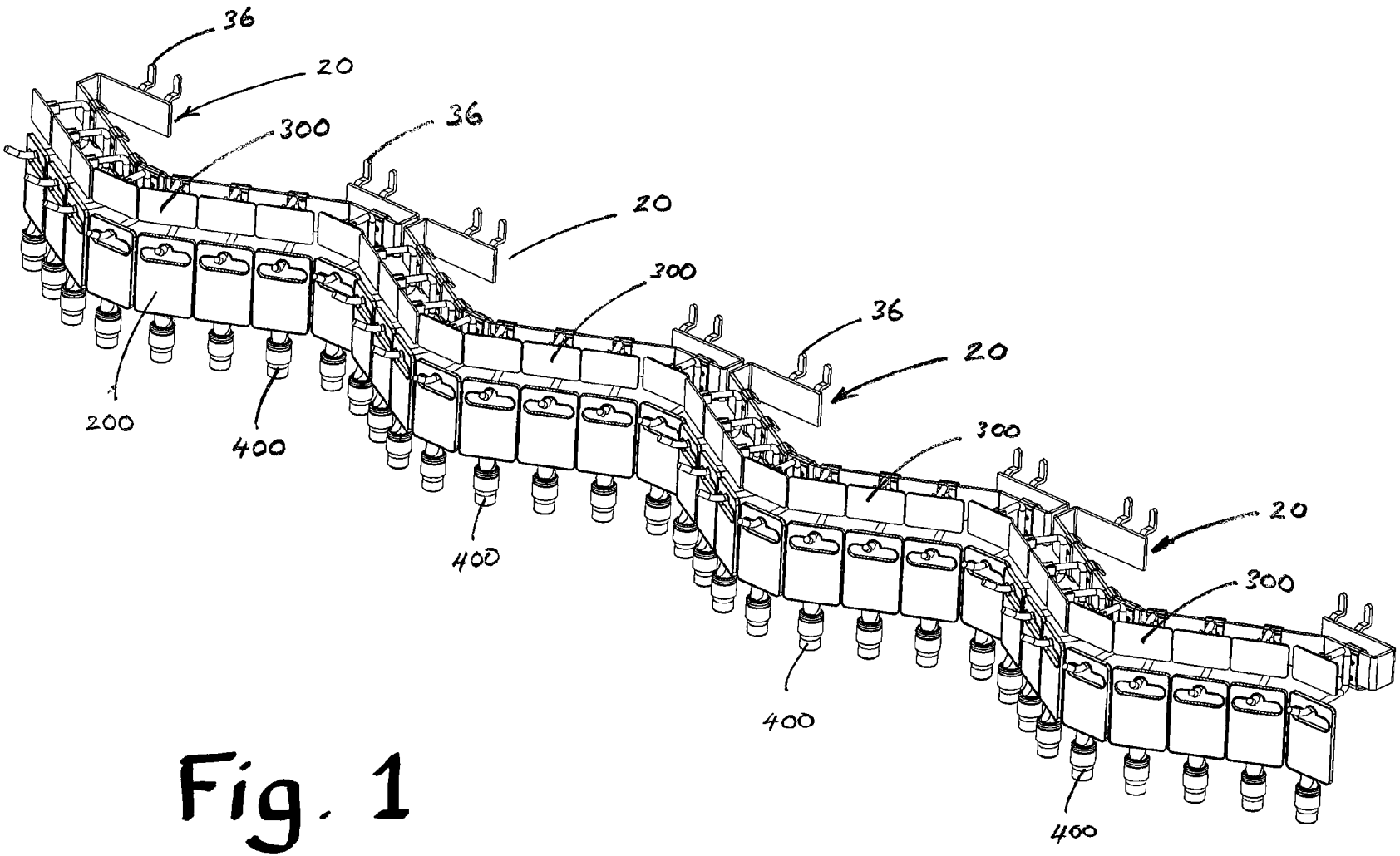
FIG. 1 is a perspective view of the invention as used in its final configuration, to support and display merchandise for sale.

Referring now to the drawings, there is shown a merchandize display system that includes features of the present invention. When used in the intended manner, the final configuration of the system permits a vendor of goods to display goods for sale in an advantageous way, one which permits increasing the number of items that can be displayed in a fixed linear space. A first embodiment of this final configuration is exemplified in FIG. 1.

Figure 2:
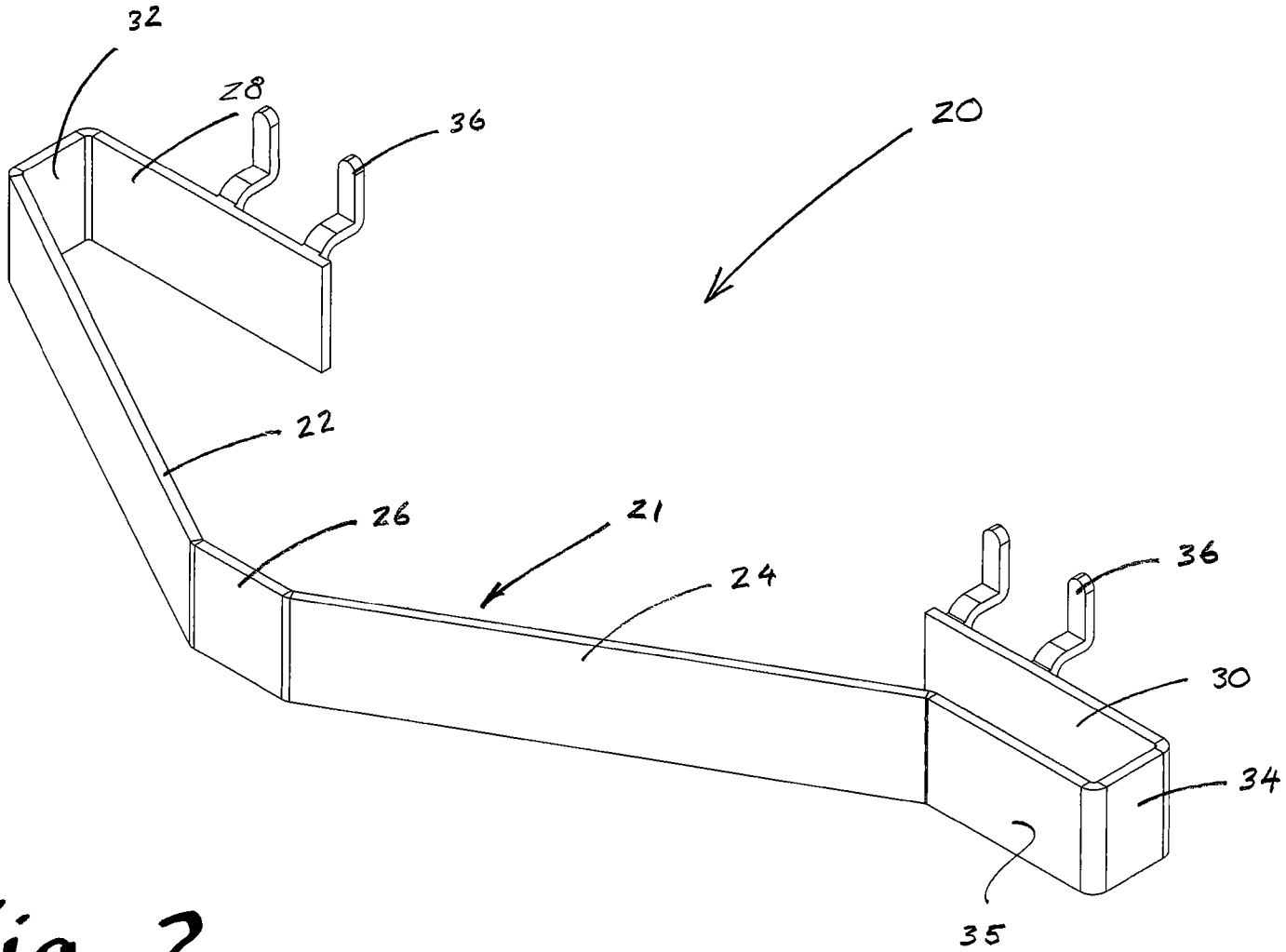
FIG. 2 is a perspective view of a modular unit which is a building-block of the present invention.
Figure 3:
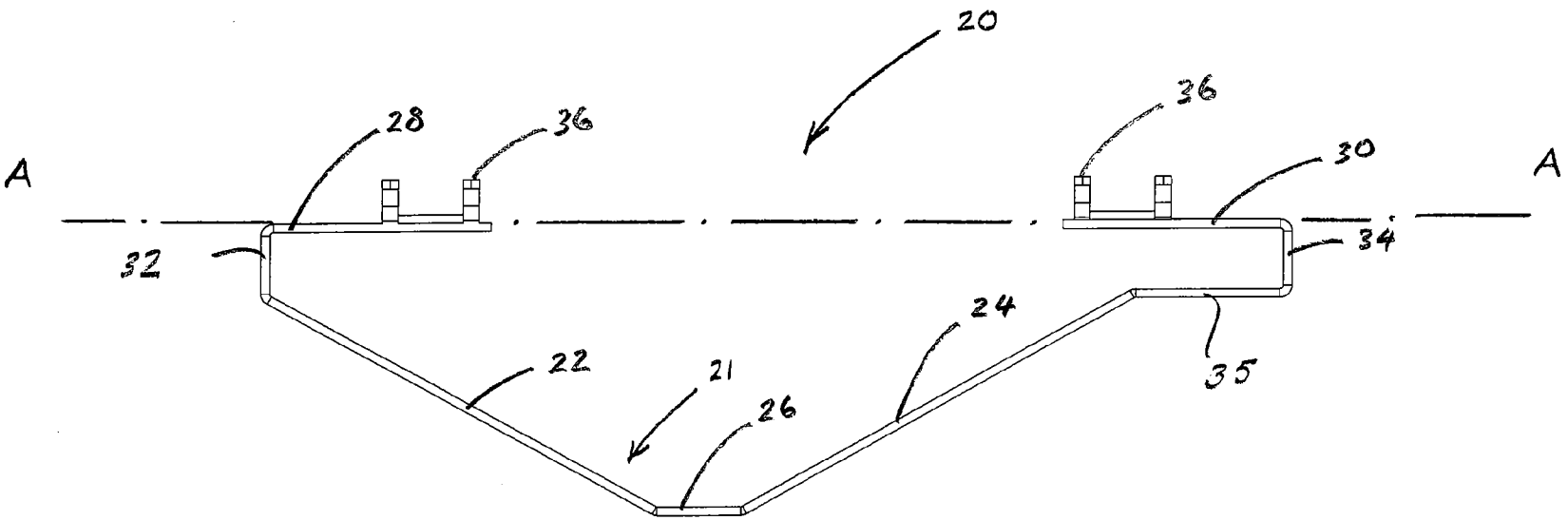
FIG. 3 is a top view of the modular unit of FIG. 2.
Figure 4:
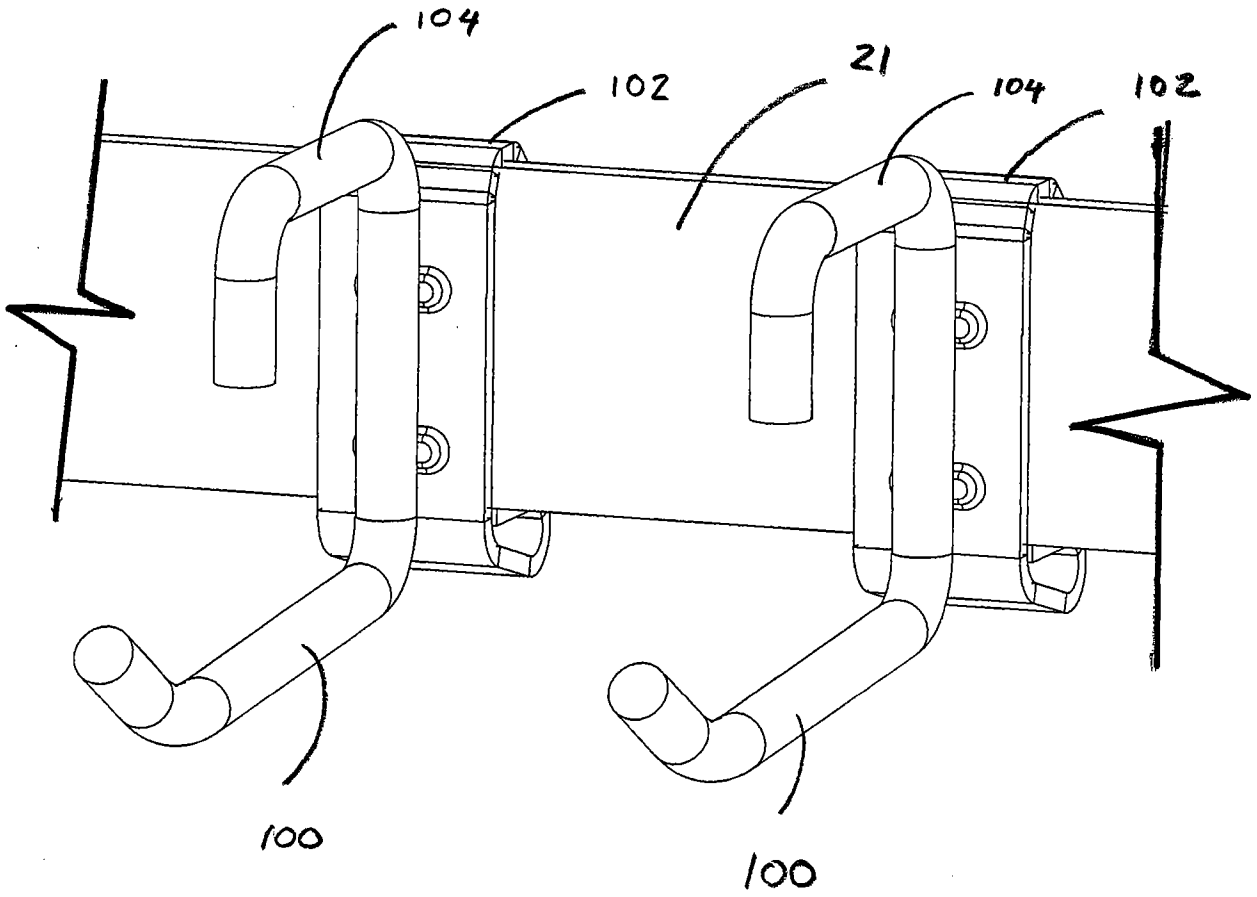
FIG. 4 is a perspective view of merchandise hooks that are used in conjunction with the modular unit of FIGS. 2 and 3.
Figure 5:
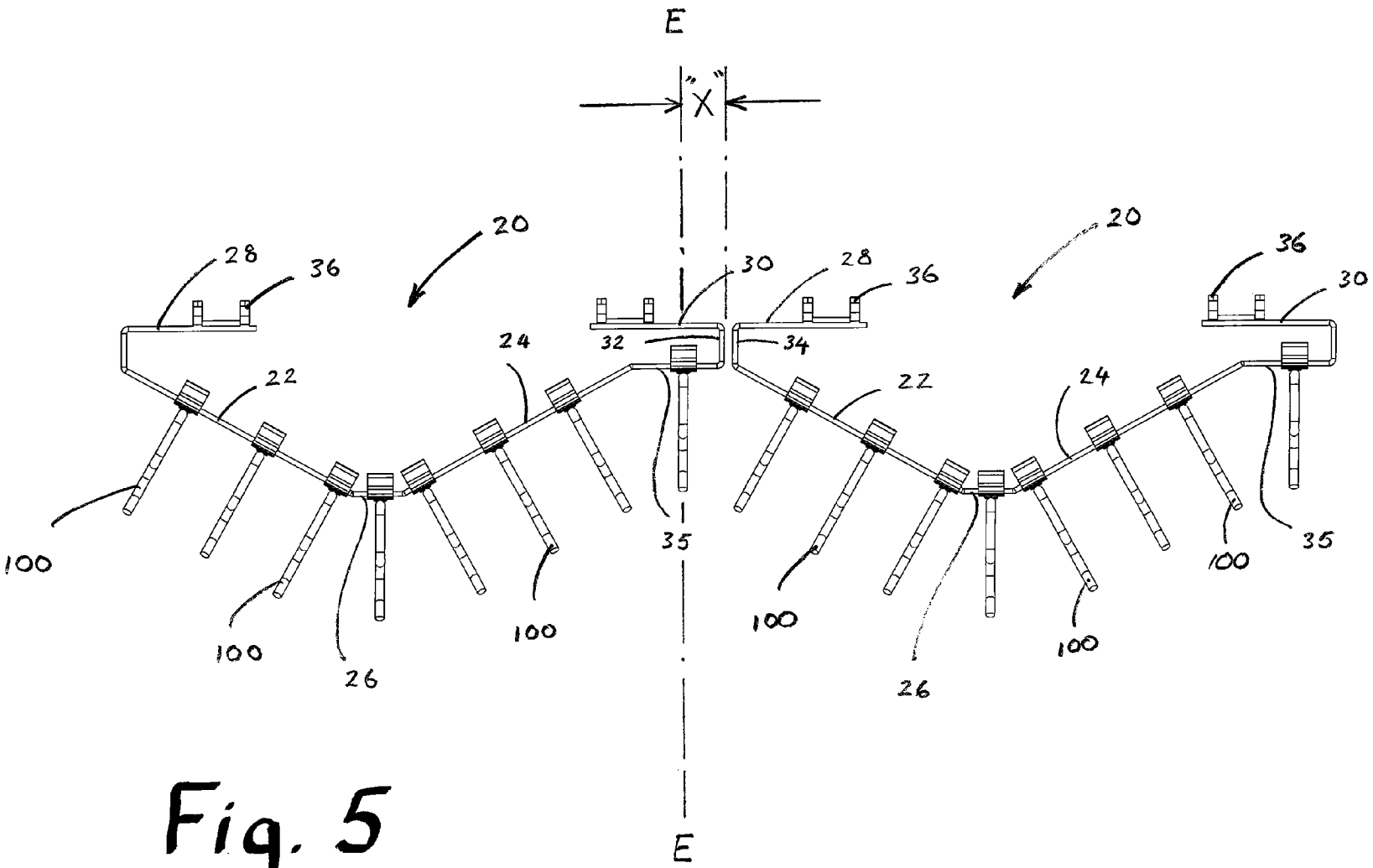
FIG. 5 is a top view of two modular units as exemplified in FIGS. 2 and 3, shown positioned adjacent and abutting each other, and equipped with the hooks of FIG. 4.
Figure 6:
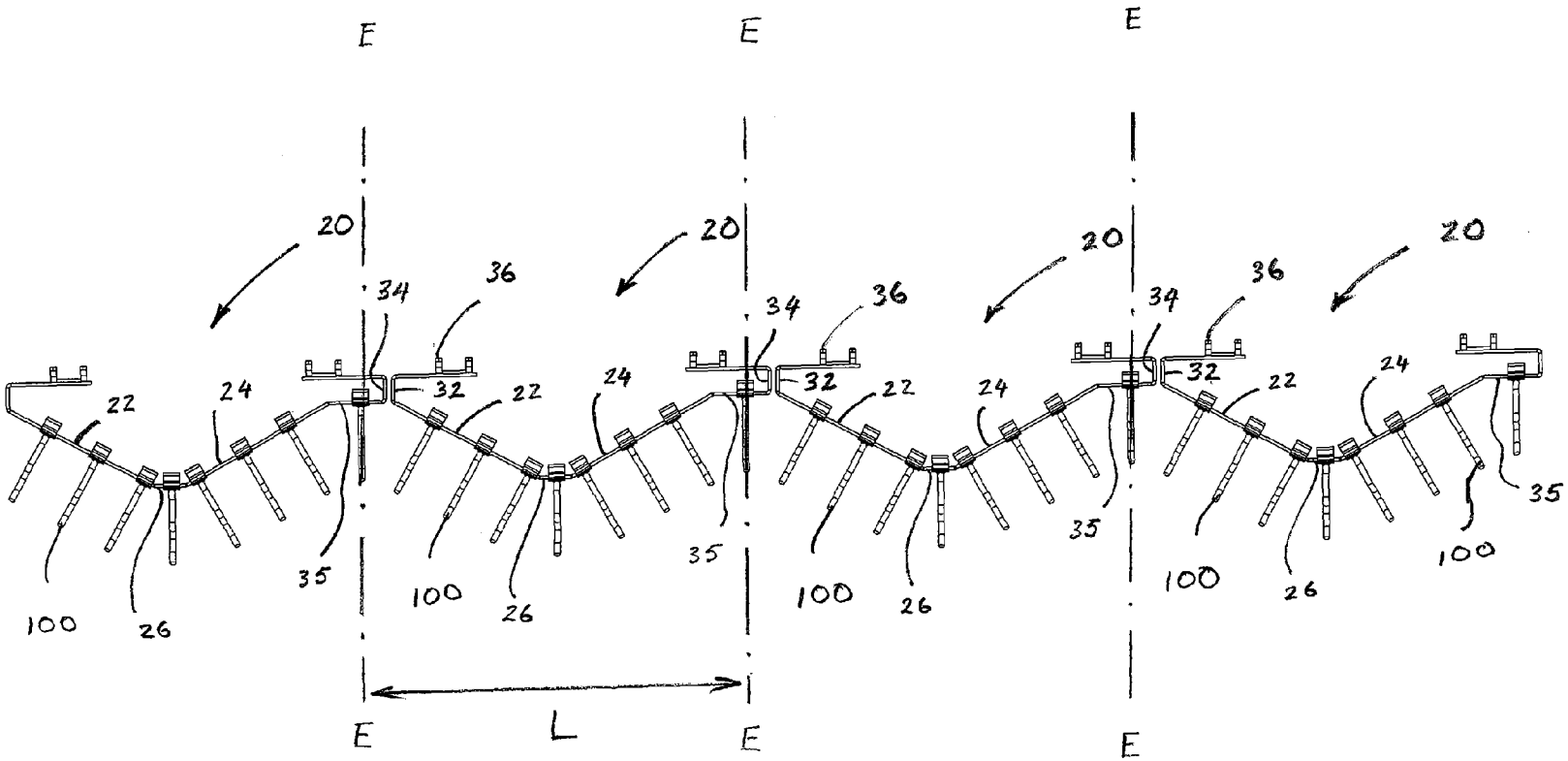
FIG. 6 is a top view of four modular units as exemplified in FIGS. 2 and 3, showing a repeating wave pattern provided by the units.
Figure 7:
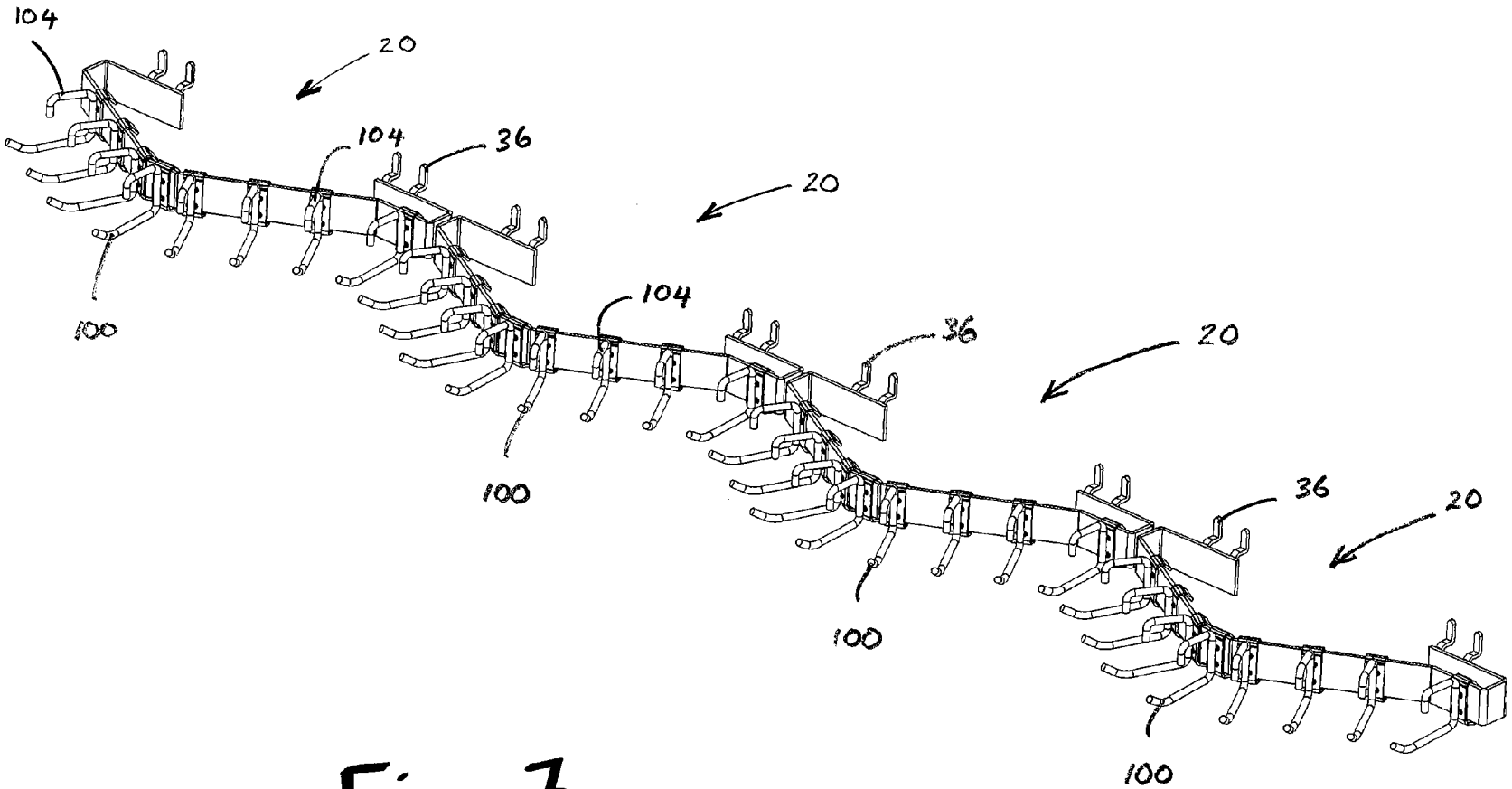
FIG. 7 is a perspective view of the four modular units shown in FIG. 6.

In order to arrive at this final configuration, the system comprises a basic modular unit 20 that is exemplified in FIGS. 2 and 3. The modular unit 20 includes a non-linear bar 21 that is specially shaped to support, within the parameters of the space allowed for the display system, a large number of product items that are closely and evenly spaced from each other for merchandising display. Preferably, the bar 21 has a rectangular cross section with the largest dimension extending vertically, and the smallest dimension extending horizontally. This configuration permits the bar to support a number of merchandise hooks 100 which are clipped onto the bar 21 with a clipping attachment 102 as seen in FIGS. 5-7. As seen in FIG. 1, the merchandise hooks 100 extend forwardly from the bar and are adapted to support merchandise items 400 that have been appropriately packaged with a support holder 200 adapted to be suspended from a hook 100. Further, a labeling hook 104 may extend above each merchandise hook 102, adapted to support a label 300 displaying the price, description, and brand of each item of merchandise.

Furthermore, the modular unit includes a plurality of pegboard hooks 36 that are attached to the non-linear bar 21. Each hook 36 is spaced laterally apart from an adjacent hook and all the hooks are positioned in linear alignment with each other because each hook is specially configured to be inserted into a hole in a pegboard (not shown) where it will be secure against withdrawal, so that the weight of the unit 20 and its associated merchandise may be supported by the pegboard.

In order to meet the shape requirements of the present invention, and as seen in the Figures, the non-linear bar 21 of each unit 20 preferably has a configuration as described below. In order to facilitate this description, some terms are defined here. A line extending through each of the pegboard hooks 36 (indicated as the line A-A in FIG. 3) is referred to as the "hook line" or the "pegboard line" because each hook 36 is positioned to find support on the plane of the pegboard. The term "front" or "fore" in relation to the unit 20 is the portion of the unit that extends outwardly away form the pegboard line and that is furthest away from the pegboard line. The term "back" or "rear" in relation to the unit 20 is the portion of the unit that is closest to or in contact with the pegboard line when mounted. The "left" of the unit is the side of the unit to the left when the unit is viewed from the front when mounted. The "right" of the unit is the side of the unit to the right when viewed from the front when mounted. The "top" of the unit is the vertically uppermost portion of the unit when it is mounted on the pegboard. The "bottom" of the unit is the vertically lowermost portion of the unit when mounted.

Turning now to the configuration of the modular unit 20, and with reference especially to FIGS. 2 and 3: At the front of the unit, the bar 21 has a front apex portion 26 that is a relatively short linear portion extending parallel to the pegboard line A-A. Extending horizontally from the left and right terminal ends of the front apex 26 is a left angled portion 22 and a right angled portion 24 respectively. Both left and right angled portions 22 and 24 are linear, and they extend backwards and simultaneously sideways (leftwards, and rightwards, respectively) away from the front apex portion 26. Attached to the left terminal end of the left angled portion 22 is a left spacer portion 32 that extends directly backwardly, perpendicular to pegboard line A-A. Attached to the right terminal end of the right angled portion 24 is a relatively short rearward apex portion 35 that extends parallel to the pegboard line A-A. Attached to the right terminal end of the rear apex portion 35 is a right spacer portion 34 that extends directly rearwardly. The rear terminal ends of the left spacer portion 32 and the right spacer portion 34 lie on the pegboard line A-A. Finally, the non-linear bar 21 may include a left support bar 28 and a right support bar 30. The left support bar 28 is linear and extends horizontally along the pegboard line, from the back terminal end of the left spacer portion 32 toward the center of the non-linear bar; and, the right support bar 30 is linear and extends horizontally along the pegboard line, from the back terminal end of the right spacer portion 34 toward the center of the unit 20. Thus, the left and right support bars are co-linear with each other, are preferably not directly connected to each other, and extend along the pegboard line A-A. Attached to each support bar is at least one bent hook 36. Each bent hook 36 is configured to be insertable into a hole on a pegboard (not shown) so as to provide support for the entire non-linear bar 21 and all attachments thereto. Thus, the two support portions are configured to provide a sturdy support to the unit 20 against a pegboard, via the support hooks 36 and the support portions.

As will be readily seen in the Figures, the configuration of the non-linear bar 21 thus described has a non-symmetrical shape that includes a portion comprising the rear apex portion 35 which extends rightwardly from the right side, but is not matched by any similar portion extending leftwardly at the left side. This asymmetry is an important aspect of the invention because it creates a structure in the unit 20 that permits an advantageously symmetrical pattern to be created when a plurality of units 20 are mounted adjacent each other in an abutting relationship on a pegboard. Specifically, the pattern is advantageous for the purpose of hanging tools from the plurality of units 20 because it advantageously increases the number of tools that may be hung for merchandising to the public.

For example, FIGS. 1, 6, and 7 show how, when two or more of the units 20 are positioned adjacent each other so that the left spacer portion 32 butts up against the right spacer portion 34, a configuration of units results that includes an effectively continuous undulating bar with a constant wavelength "L" (as indicated in FIG. 6). The repeating wavelength pattern comprises left angled portion 22, front apex portion 26, right angled portion 24 and rear apex portion 35. As seen in FIG. 5, the repeating pattern of the wavelength commences at a "node" point on the bar 21 that is approximately at the center point of the rear apex portion 35 where the rear apex portion intersects with the line E-E.

Figure 11:
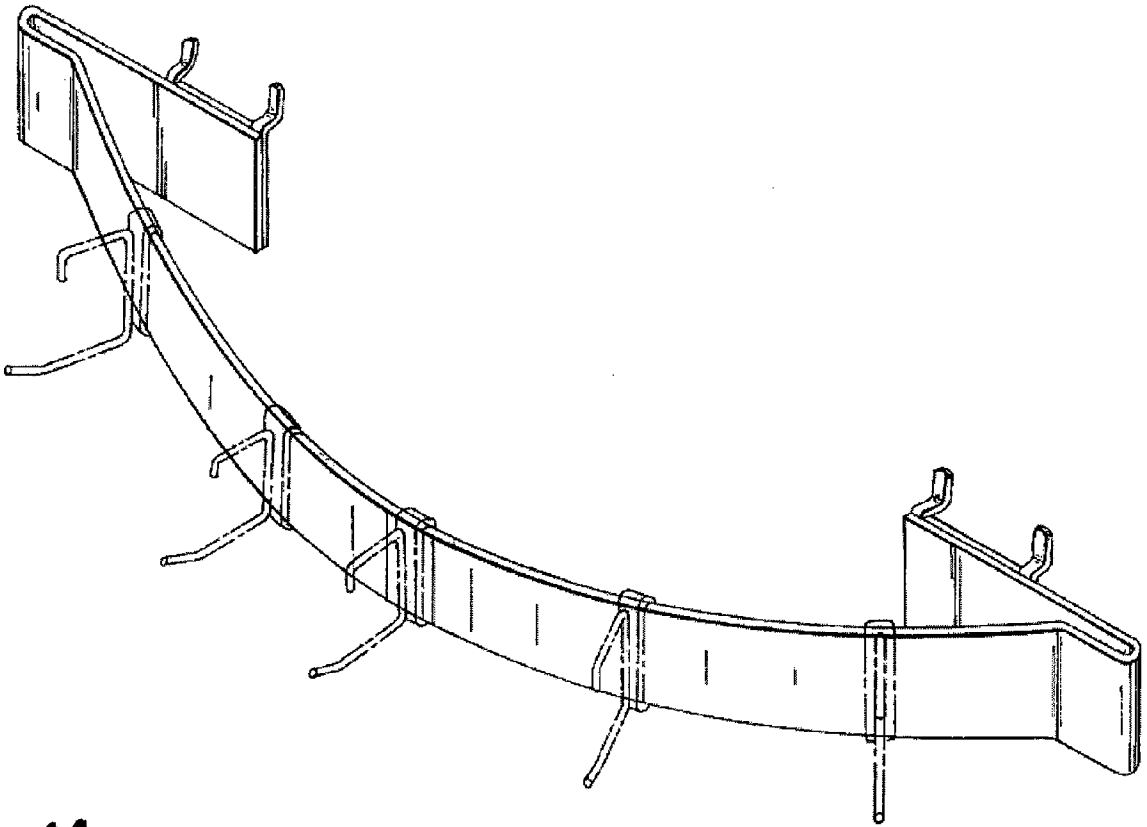
Fig. 11 (prior art)
FIG. 11 is a perspective view of a modular unit known in the prior art.
Figure 12:
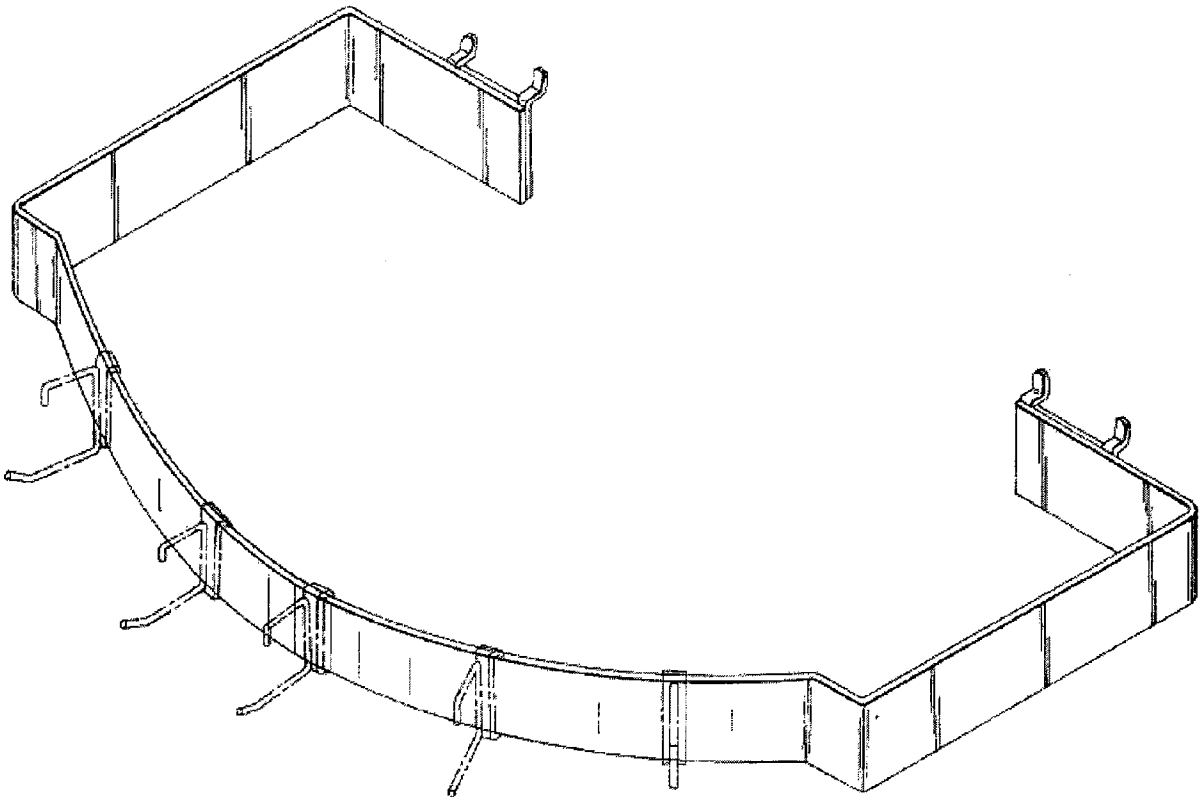
Fig. 12 (prior art)
FIG. 12 is a perspective view of a second modular unit known in the prior art.

A singular advantage of the configuration of the repeating wave pattern created by the bar 21 of a plurality of units 20 of the present invention is that the rear apex portion 35 permits a single hook to be clipped onto the bar 21 at the center of the rear apex 35 of the wave shape, coincident with the line E-E indicated in FIGS. 5 and 6. This is possible because the left spacer portion 32 and right spacer portions 34 are offset by an amount "X" from the center line E-E (as indicated in FIG. 5) by virtue of the asymmetry present in the shape of the bar 21. Were it not for the asymmetry in the shape of the bar 21 (and as would occur in the prior art as shown in FIGS. 11 and 12) the spacer portions 32 and 24 would coincide with the center line E-E, and preclude the positioning of a hook 100 at the intersection of the bar 21 and the center line E-E. Such preclusion would result in an inability to hang a product at the centerline E-E, and would result in "dead space" on the merchandizing rack at that point. This result would be particularly undesirable where a vendor has been provided a limited amount of linear store shelving space. However, the configuration of the present invention avoids this disadvantageous outcome.

Furthermore, an additional advantage provided by the configuration of the modular unit 20 of the present invention is that the wave shape permits an additional number of merchandise items 400 (see FIG. 1) to be suspended from the unit 20, as compared with a linear shape, and, depending on the depth, or amplitude, of the undulating wave shape, may permit up to 39% more units to be displayed than if the rack were linear throughout, without any undulations.

In a further embodiment of the invention, described with reference to FIGS. 8 and 9, the aspects of the invention are included in a unit 520, in which a support bar 521 of this second embodiment extends continuously over a length that would be spanned by a plurality of units 20 of the previous embodiment positioned adjacent each other as in FIG. 6. The bar 521 of the present embodiment continuously follows the same wavelike path as the path followed by a plurality of bars 21 situated adjacent each other in the configuration of the previous embodiment as shown for example in FIG. 6. In the present embodiment, there are a total of only two spacer arms 532, 534 on the extremities of the unit which connect directly to a pegboard (not shown). As in the previous embodiment, the support bar 521 is configured to support a plurality of merchandise hooks 100, each adapted to support merchandise for display to the consumer public. (FIGS. 8 and 9.)

Figure 8:
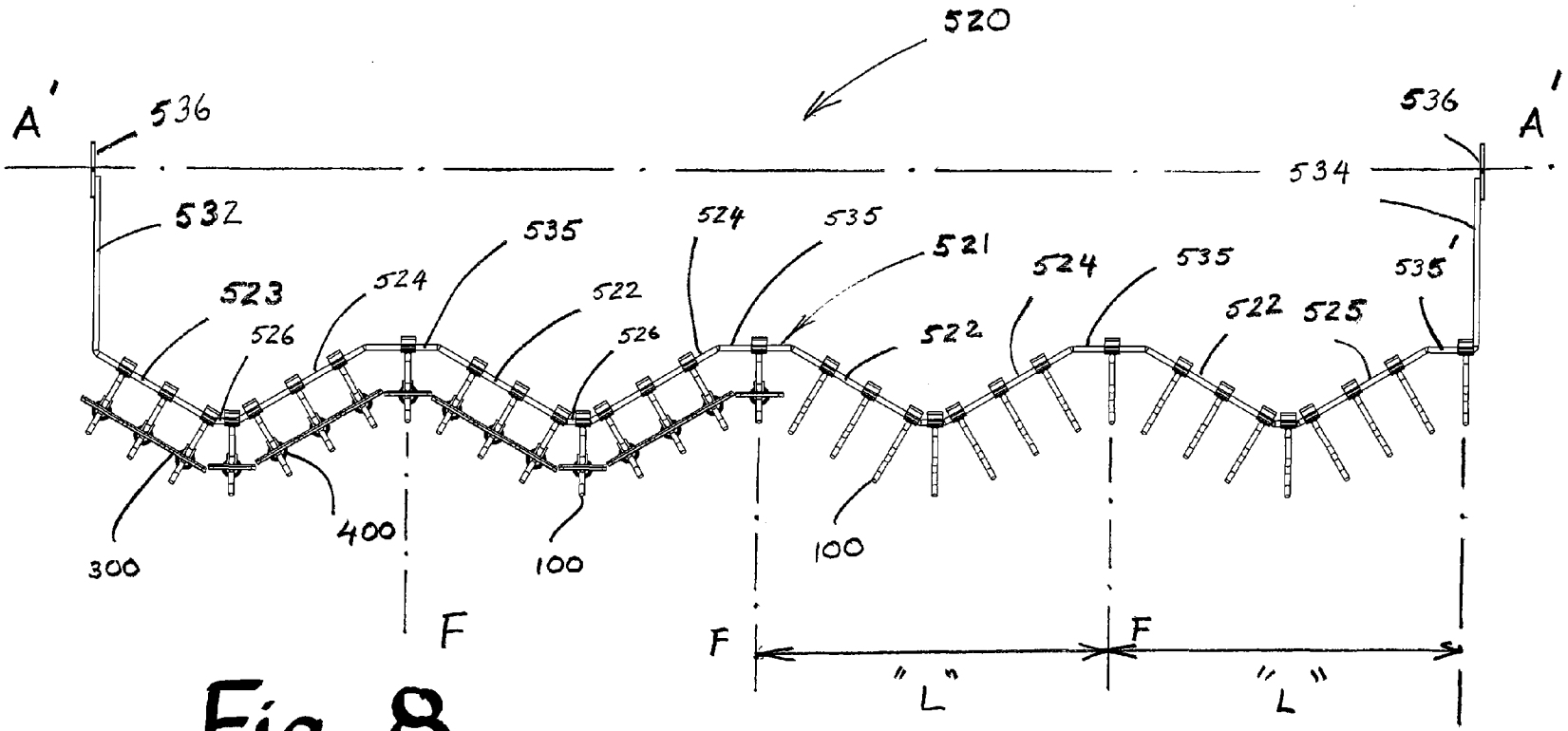
FIG. 8 is a top view of a second embodiment of the invention.
Figure 9:
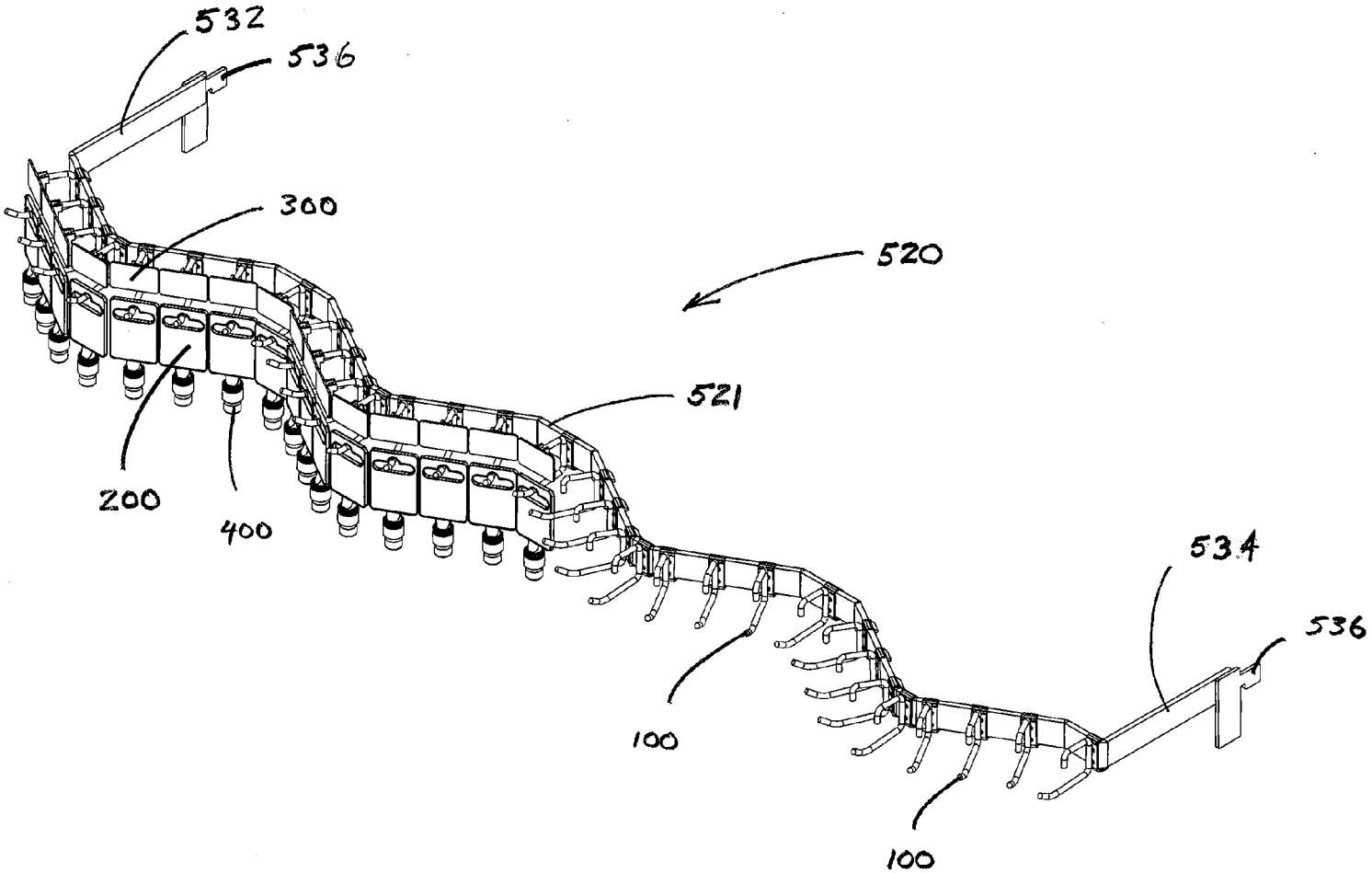
FIG. 9 is a perspective view of the embodiment in FIG. 8.
Figure 10:
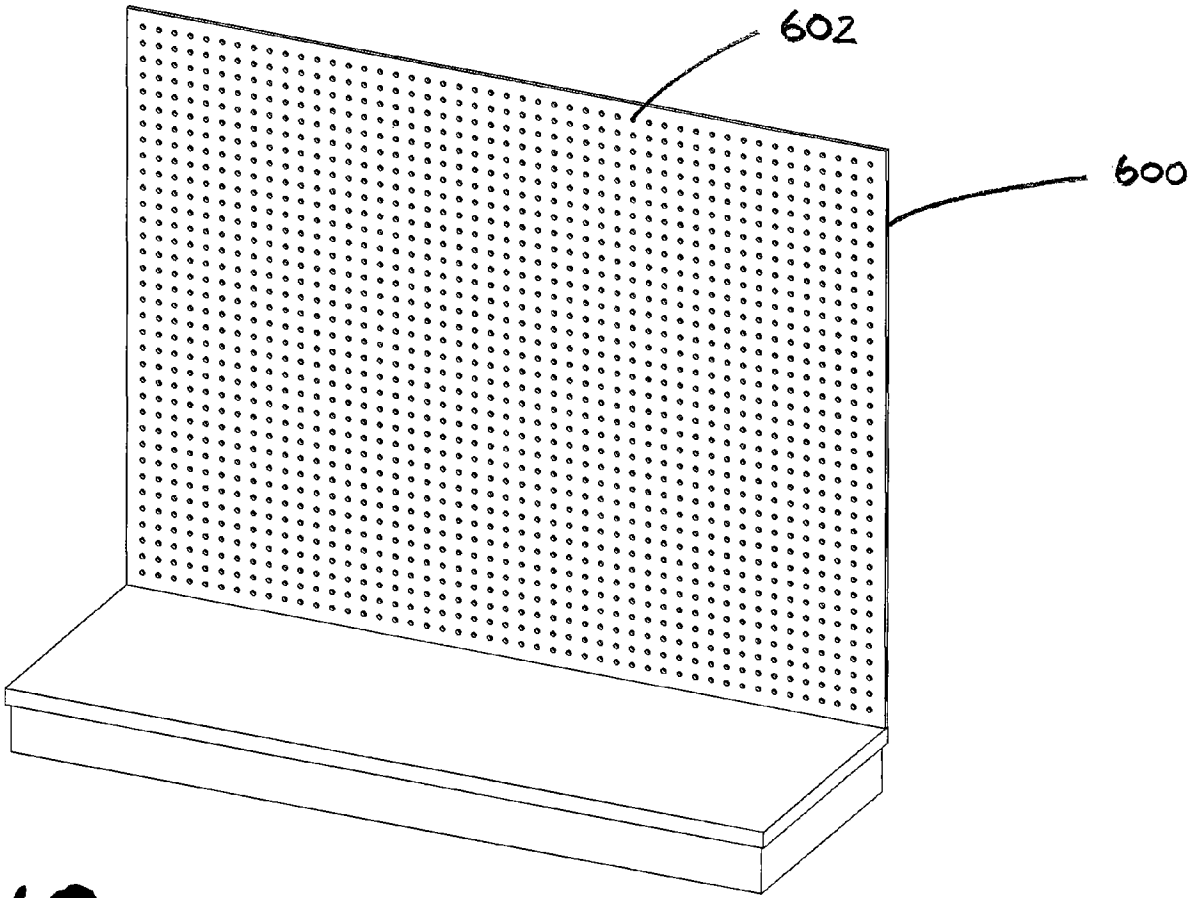
FIG. 10 is a perspective view of a typical known pegboard.

Thus, the Further Embodiment Comprises a Support Bar 521 that has a Plurality of Front apex portions 526 that are relatively short linear portions extending parallel to the pegboard line A'-A', as shown in FIG. 8. All front apex portions 526 are co-linear with each other. Extending horizontally from the left and right terminal ends of each front apex 526 is a left angled portion 522 and a right angled portion 524 respectively. Both left angled portions and right angled portions are linear and they extend backwards and simultaneously sideways (leftwards and rightwards respectively) away from the front apex portion 526. As a result, the support bar has a single extreme left angled portion 523 and a single extreme right angled portion 525, and a plurality of intermediate left angled portions 522 and intermediate right angled portions 524 as seen in FIGS. 8 and 9. The intermediate left angled portions 522 and intermediate right angled portions 524 are each connected to opposite ends of a rearward apex portion 535 that extend parallel to the pegboard line A-A to form a continuous structure. The extreme left angled portion 523 is connected to a first end of a left spacer portion 532. A second end of the left spacer portion 532 is connected via hooks 536 to a pegboard (not shown in FIGS. 8 and 9) to support the unit 520. The extreme right angled portion 525 is connected to a rear apex portion 535 extending parallel with the pegboard line A-A and co-linear with the other rear apex portions. Thus, the configuration of this second embodiment shares a feature of the first embodiment in that the non-linear bar 521 similarly has a non-symmetrical shape that includes a portion comprising the extreme right rear apex portion 535 which extends rightwardly from the right side, but is not matched by any similar portion extending leftwardly at the left side. Likewise with the first embodiment, the asymmetry of the second embodiment is an important aspect of the invention because it creates a structure in the unit 520 that permits an advantageously symmetrical pattern to be created when a plurality of units 520 are mounted adjacent each other in an abutting relationship on a pegboard (abutment configuration of units 520 not shown in the Figures). The horizontal abutment between two units 520 provides a single rear apex portion 535 at the point of abutment between the units that is capable of receiving one merchandising hook 100, in a similar way and with similar advantageous result as with the first embodiment because, as in the case of the first embodiment, this additional space for a merchandizing hook 100 advantageously increases the number of merchandize items 400 that may be included in a fixed amount of linear display space.

Thus, there has been described a configuration for a merchandising display rack that overcomes shortcomings in the prior art, and that permits an advantageous number of items of merchandise to be displayed in limited linear shelving space. The present invention may, of course, be carried out in other specific ways than those herein set forth without departing from the essential characteristics of the invention. For example, each "left" and "right" may be interchanged with each other to provide the same invention in mirror image. The present embodiments are, therefore, to be considered in all respects as illustrative and not restrictive, while the scope of the invention is set forth in the claims that follow.

We claim:

1. A modular rack for displaying merchandise comprising:

at least two bars, each bar having an asymmetrical shape and comprising:

a left support portion that is linear and extends along a line;

a right support portion that is linear and extends co-linearly along the same line as the left support portion, the right support portion being spaced apart from the left support portion;

a front apex portion that is linear and extends parallel to the line, the front apex portion having a left terminal end and a right terminal end;

a left angled portion that is linear, is connected to the left terminal end of the front apex portion, and extends backwards and also leftwards away from the front apex portion;

a right angled portion that is linear, is connected to the right terminal end of the front apex portion, and extends backwards and also rightwards away from the front apex portion;

a rear apex portion that is linear, is connected to a right terminal end of the right angled portion, and extends parallel to the line;

a left spacer portion that is linear, is connected at one end to a left terminal end of the left angled portion and is connected at an opposite end to a left terminal end of the left support portion, the left spacer portion and the left support portion being connected perpendicular to each other;

a right spacer portion that is linear and has the same length as the left spacer portion, the right spacer portion being connected at one end to a right terminal portion of the rear apex portion, and is connected at an opposite end to a right terminal end of the right support portion, the right spacer portion and the right support portion being connected perpendicular to each other; and at least one hook attached to each of the right hand support portion and the left hand support portion of each non-linear bar, each hook being configured for insertion into a hole of a pegboard for providing support to the rack;

wherein, juxtaposition of two non-linear bars beside each other with the right spacer portion of a first non-linear bar abutting the left spacer portion of an adjacent non-linear bar results in a wave shaped pattern comprising the left angled portion, the front apex portion, the right angled portion and the rear apex portion of each non-linear bar; and further including a plurality of hooks attached to each bar, the hooks being adapted to suspend merchandise for inspection by consumers.

2. The modular rack of claim 1, wherein each of the left spacer portion and the right spacer portion are between 0.5 inches and 1.5 inches in length.

3. The modular rack of claim 1, wherein each of the left angled portion and the right angled portion are between 4 inches and 7 inches in length.

4. The modular rack of claim 1, wherein a right terminal end of the left support portion and a left terminal end of the right support portion are separated from each other by a gap.

5. The modular rack of claim 1, wherein the right angled portion has the same length as the left angled portion.

6. The modular rack of claim 4, wherein the left angled portion extends backwards and leftwards away from the front apex portion at a first angle, and the right angled portion extends backwards and rightwards away from the front apex portion at a second angle that is the same as the first angle, so that the left and right angled portions form a "V" shape, with the front apex portion situated at the apex of the "V."

7. The modular rack of claim 1, wherein the left spacer portion joins the left support portion at a right angle, and the right spacer portion joins the right support portion at a right angle.

8. A modular rack for displaying merchandise comprising:

at least two bars, each bar having an asymmetrical shape and comprising:

a plurality of front apex portions that are linear and extend parallel to a horizontal line, the front apex portions each having a left terminal end and a right terminal end;

a plurality of left angled portions that are linear, each one connected to a left terminal end of a respective one of the front apex portions, and extending backwards and also leftwards away from the respective front apex portion;

a plurality of right angled portions that are linear, each one connected to a right terminal end of a respective one of the front apex portions, and extending backwards and also rightwards away from the front apex portion;

a plurality of rear apex portion that are linear, each one connected to a right terminal end of a respective right angled portion, and extending parallel to the horizontal line;

a left spacer portion that is linear extending perpendicular to the line, is connected at one end to a left terminal end of an extreme left angled portion, and is provided with a hook for connection to a pegboard; and a right spacer portion that is linear extending perpendicular to the line and has the same length as the left spacer portion, the right spacer portion being connected at one end to a right terminal portion of a right extreme rear apex portion, and is provided with a hook for connection to a pegboard;

wherein, juxtaposition of two non-linear bars beside each other with the right spacer portion of a first non-linear bar abutting the left spacer portion of an adjacent non-linear bar results in a uniform wave shaped pattern comprising left angled portions, front apex portions, right angled portions and rear apex portions of each non-linear bar. and further including a plurality of hooks attached to each bar, the hooks being adapted to suspend merchandise for inspection by consumers.

9. The modular rack of claim 8, wherein each of the left spacer portions and the right spacer portions are between 0.5 inches and 1.5 inches in length.

10. The modular rack of claim 8, wherein each of the left angled portions and the right angled portions are between 4 inches and 7 inches in length.

11. The modular rack of claim 8, wherein all the right angled portions have the same length as all the left angled portions.

12. The modular rack of claim 11, wherein each left angled portion extends backwards and leftwards away from the respective front apex portion at a first angle, and each right angled portion extends backwards and rightwards away from the respective front apex portion at a second angle that is the same as the first angle, so that the left and right angled portions form a "V" shape, with the front apex portion situated at the apex of the "V."

13. The modular rack of claim 12, wherein the first angle and the second angle are between 30 degrees and 40 degrees.

* * * * *